US010124379B2

(12) United States Patent
Lenz et al.

(10) Patent No.: US 10,124,379 B2
(45) Date of Patent: Nov. 13, 2018

(54) MULTIROLL ROLLING MILL INCORPORATING A HATCH

(71) Applicant: FIVES DMS, Noyelles-les-Seclin (FR)

(72) Inventors: Klaus Lenz, Noyelles-les-Seclin (FR); Jeremie Freliez, Noyelles-les-Seclin (FR); Conrad Ernst De La Graete, Noyelles-les-Seclin (FR)

(73) Assignee: FIVES DMS, Noyelles-les-Seclin (FR)

( * ) Notice: Subject to any disclaimer, the term of this patent is extended or adjusted under 35 U.S.C. 154(b) by 85 days.

(21) Appl. No.: 15/035,343

(22) PCT Filed: Nov. 14, 2014

(86) PCT No.: PCT/FR2014/052913

§ 371 (c)(1),
(2) Date: May 9, 2016

(87) PCT Pub. No.: WO2015/071608

PCT Pub. Date: May 21, 2015

(65) Prior Publication Data

US 2016/0288179 A1 Oct. 6, 2016

(30) Foreign Application Priority Data

Nov. 15, 2013 (FR) ..... 13 61171

(51) Int. Cl.
*B21B 31/18* (2006.01)
*B21B 13/14* (2006.01)

(52) U.S. Cl.
CPC ..... *B21B 13/147* (2013.01); *B21B 31/18* (2013.01)

(58) Field of Classification Search
CPC ..... B21B 13/14; B21B 13/147; B21B 31/18; B21B 31/16
See application file for complete search history.

(56) References Cited

U.S. PATENT DOCUMENTS 5,193,377 A 3/1993 Sendzimir et al.
5,471,859 A 12/1995 Sendzimir et al.

FOREIGN PATENT DOCUMENTS

DE 32 21 346 A1 12/1983
DE 36 31 171 A1 3/1988
(Continued)

OTHER PUBLICATIONS

Translation of JP55-048413A, translation on Oct. 30, 2017, pp. 1-4.*

(Continued)

*Primary Examiner* — Teresa M Ekiert
(74) *Attorney, Agent, or Firm* — Young & Thompson

(57) ABSTRACT

A rolling mill (100) includes: —a rolling-mill cage (10) containing a plurality of cylinders, including two working cylinders (12) and two pairs of intermediate cylinders (13), —a main gate (30) on the front face of the rolling mill (100) for accessing all the cylinders, —a device (20) for the lateral movement of the intermediate cylinders (13) of the push-push type including first and second pairs of hydraulic actuators (22, 22', 21, 21') each configured so as to exert a thrust force (P) to allow a lateral movement of the intermediate cylinders (13), —a removable small gate (40) fixed to the main gate (30), allowing access to the cylinders (12) and (13), and integrating the second pair of hydraulic actuators (21, 21') so that opening and closing the small gate (40) does not interfere with the opening and closing of the main gate (30).

15 Claims, 14 Drawing Sheets

(56) References Cited

FOREIGN PATENT DOCUMENTS

| | | |
|---|---|---|
| EP | 1 213 060 A1 | 6/2002 |
| JP | S55 48413 A | 4/1980 |

OTHER PUBLICATIONS

International Search Report, dated Feb. 10, 2015, from corresponding PCT application.

* cited by examiner

MULTIROLL ROLLING MILL INCORPORATING A HATCH

The present invention relates to the field of rolling mills and relates more particularly to cold-rolling mills.

The present invention thus finds an advantageous application for multi-cylinder rolling mills, such rolling mills typically being Sendzimir rolling mills.

Cold rolling makes it possible to obtain the final thickness of a metal strip by successive passages of this strip between the cylinders with high forces present simultaneously in pressure and traction.

A rolling mill of the Sendzimir type comprises a plurality of cylinders, or rollers, which are arranged with respect to one another so as to change the mechanical characteristics of a metal strip and to obtain a strip thickness that may be less than 3 millimeters.

More particularly, a Sendzimir rolling mill is known that may comprise twenty cylinders; an example embodiment of such a twenty-cylinder rolling mill is illustrated in the documents U.S. Pat. Nos. 5,193,377 and 5,471,859.

Figure 1:
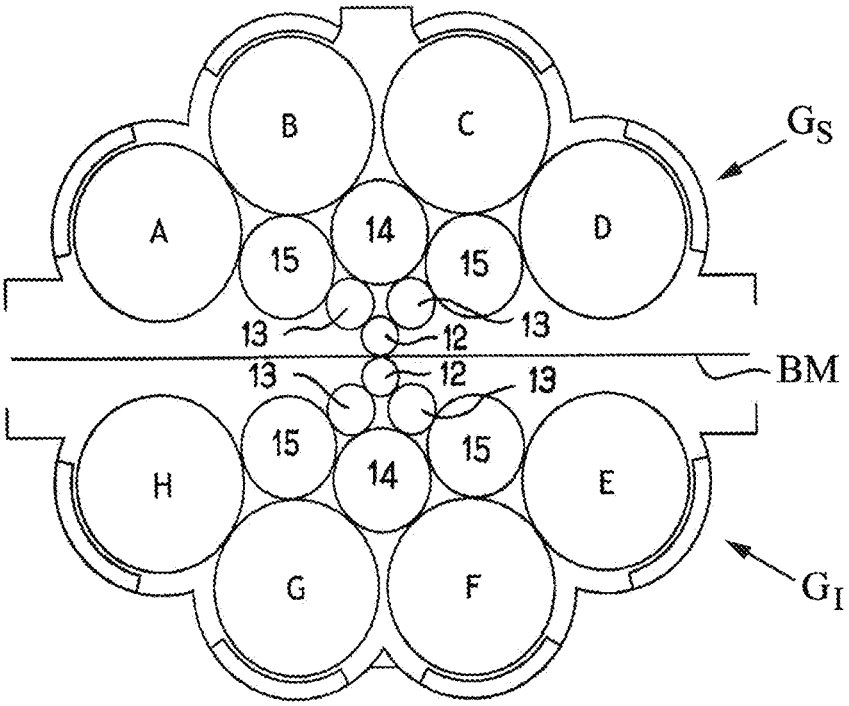
FIG. 1 PRIOR ART

FIG. 1 accompanying the present description comes from these two applications.

This FIG. 1 depicts a schematic view of a cross section of a twenty-cylinder rolling mill. In this figure, the cylinders are distributed in a lower group $G_I$ and an upper group $G_S$; more precisely, these groups $G_I$ and $G_S$ have a symmetrical structure and each comprise ten cylinders including: a working cylinder 12, two first intermediate cylinders 13, three second intermediate cylinders 14 and 15, and four support cylinders, or support rollers, which are outside the arrangement and are denoted A, B, C and D for the upper group $G_S$ and E, F, G, H for the lower group $G_I$.

This naming for the various cylinders constituting a twenty-cylinder rolling mill is normal in the field of rolling mills, and well known to persons skilled in the art.

It is recognised in the field of rolling mills that this arrangement of cylinders illustrated in FIG. 1 makes it possible to effectively work a metal strip BM in order to obtain the required strip thickness.

Because of the forces exerted on the working cylinders 12 and the two first intermediate cylinders 13 when working a metal strip BM, these parts 12 and 13 require regular maintenance: it is therefore desirable to be able to easily access the inside of the rolling mill stand in order to perform these maintenance operations so as to allow for example replacement and/or inspection of these parts 12 and 13.

It is possible to open the main gate of the rolling mill to access all the cylinders. However, although motorised, opening and closing such a gate takes a long time. Furthermore, opening and closing this main gate prevents the positioning of the cylinder change carriage very close to the rolling-mill stand.

This is because this carriage can make its approach travel to the rolling mill only after complete opening of the main gate; conversely, the main gate can begin to close only after the cylinder-change carriage has moved away from the area swept by the main gate.

Consequently the times necessary for these advance and retraction movements of the cylinder-removal carriage are detrimental to the overall cylinder-replacement time.

In addition, the movements of this carriage present a risk for the safety of persons responsible for replacing the cylinders.

Figure 2A:
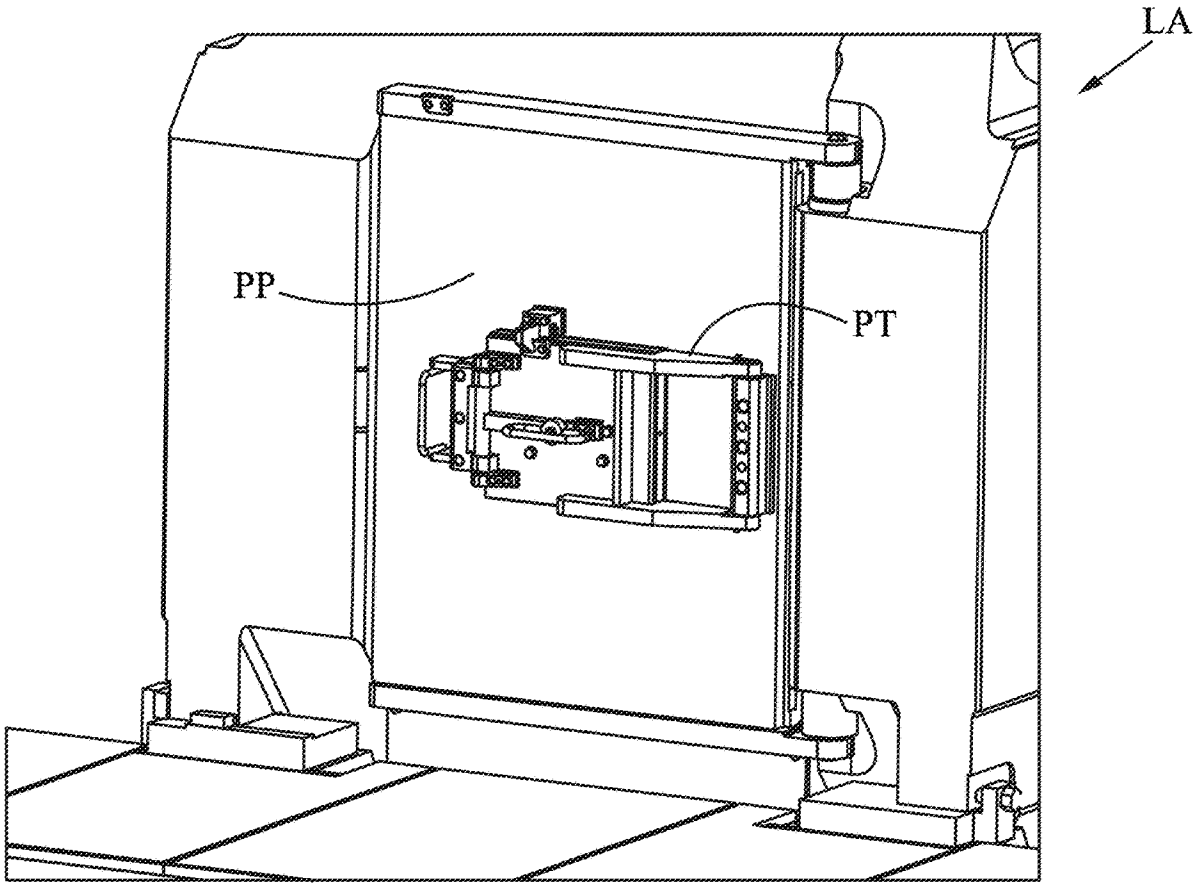
FIG. 2a PRIOR ART

Alternatively, as illustrated in FIG. 2*a*, there exists a solution that consists of equipping the main gate PP of the rolling mill LA with a simple small gate PT situated at the centre thereof: such a small gate PT allows rapid and safe changing of the working cylinders 12 and the first intermediate cylinders 13, without requiring the main gate PP to be opened. The opening and closing of such a small gate PT (less heavy and less bulky than the main gate) are much more rapid and less dangerous than opening and closing the main gate PP.

Moreover, opening and closing the simple small gate accepts the presence of the cylinder-removal carriage close to the rolling-mill stand.

The movements thereof can therefore take place in complete safety for the operator since they take place at very low speed and without the presence of the operators necessary for replacing the cylinders.

Furthermore, when the main gate is opened, there are often trickles of rolling liquid since the low part of the cage of the rolling mill has not had time to be completely drained of the rolling liquids.

Use of the small gate PT avoids such trickling since the main gate remains closed.

The small gate PT therefore enables the operator to replace the cylinders 12 and 13 in complete safety since the main gate PP of the rolling mill LA remains closed during the maintenance operations.

The presence of a small gate PT as illustrated in FIG. 2*a* for accessing the working cylinders 12 and the first intermediate cylinders 13 is therefore very much appreciated by the operators and significantly reduces the maintenance time.

Nevertheless, with the current small gates as illustrated in FIG. 2*a*, the device for lateral movement of the first intermediate cylinders can be only a system of the push-pull type.

Figure 2B:
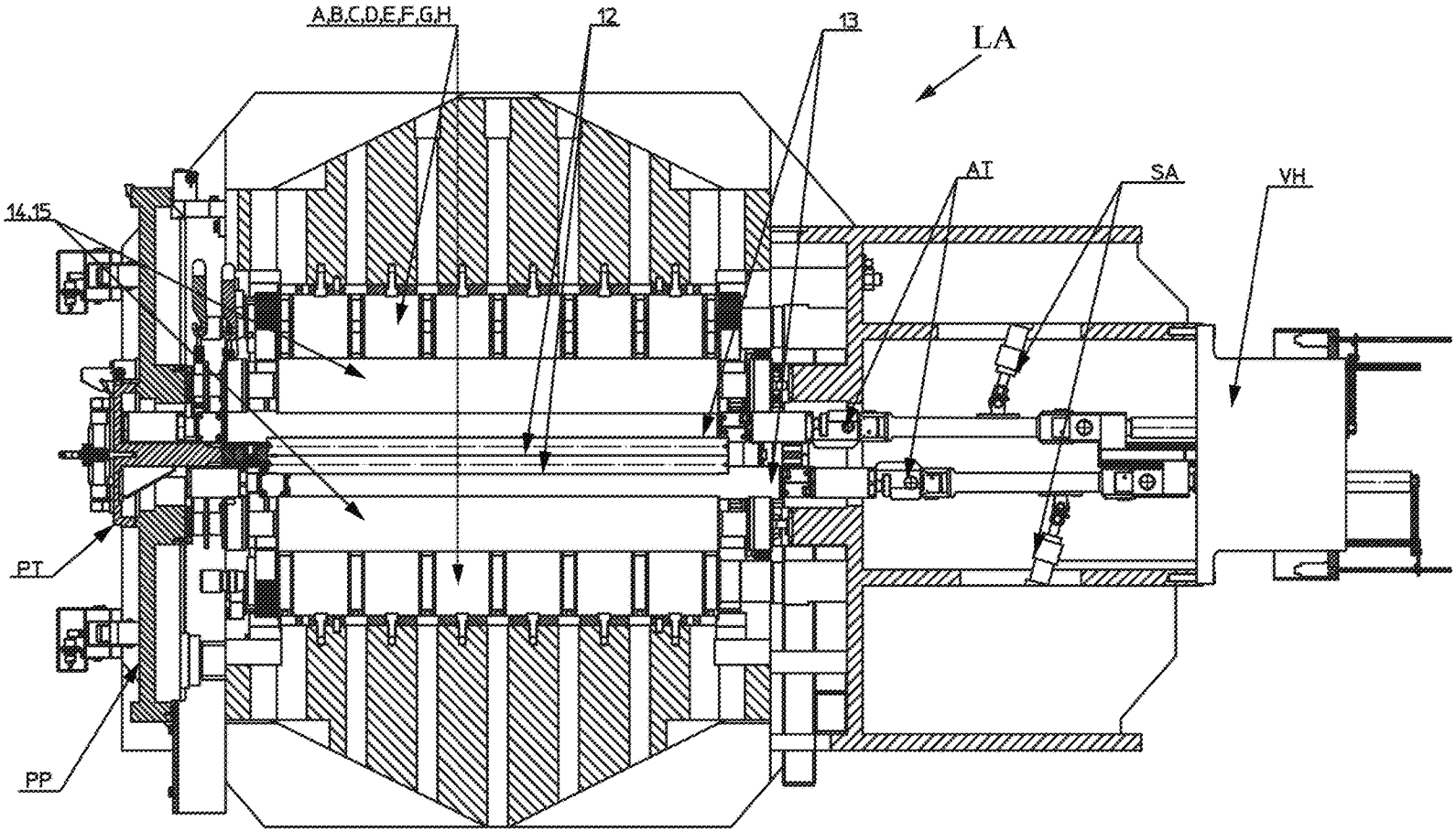
FIG. 2b PRIOR ART

Such a push-pull system, illustrated in FIG. 2*b*, comprises an arrangement of hydraulic actuators VH configured so as to alternately "push" and "pull" the first intermediate cylinders 13; such a system is installed in the bottom of the rolling-mill stand.

This "push-pull" system requires the use of a coupling arrangement AT for firmly connecting the hydraulic actuators VH to the first intermediate cylinders 13.

However, this arrangement AT has reliability problems; frequent damage and difficulties in attachment when the first intermediate cylinders 13 are changed are observed in particular for obvious reasons of lack of visibility of the coupling AT, which is situated in the bottom of the rolling-mill stand.

Moreover, the push-pull system uses complex parts and coupling-suspension actuators SA, which are subject to rapid wear and to breakages through overloading during rolling accidents.

Figure 3:
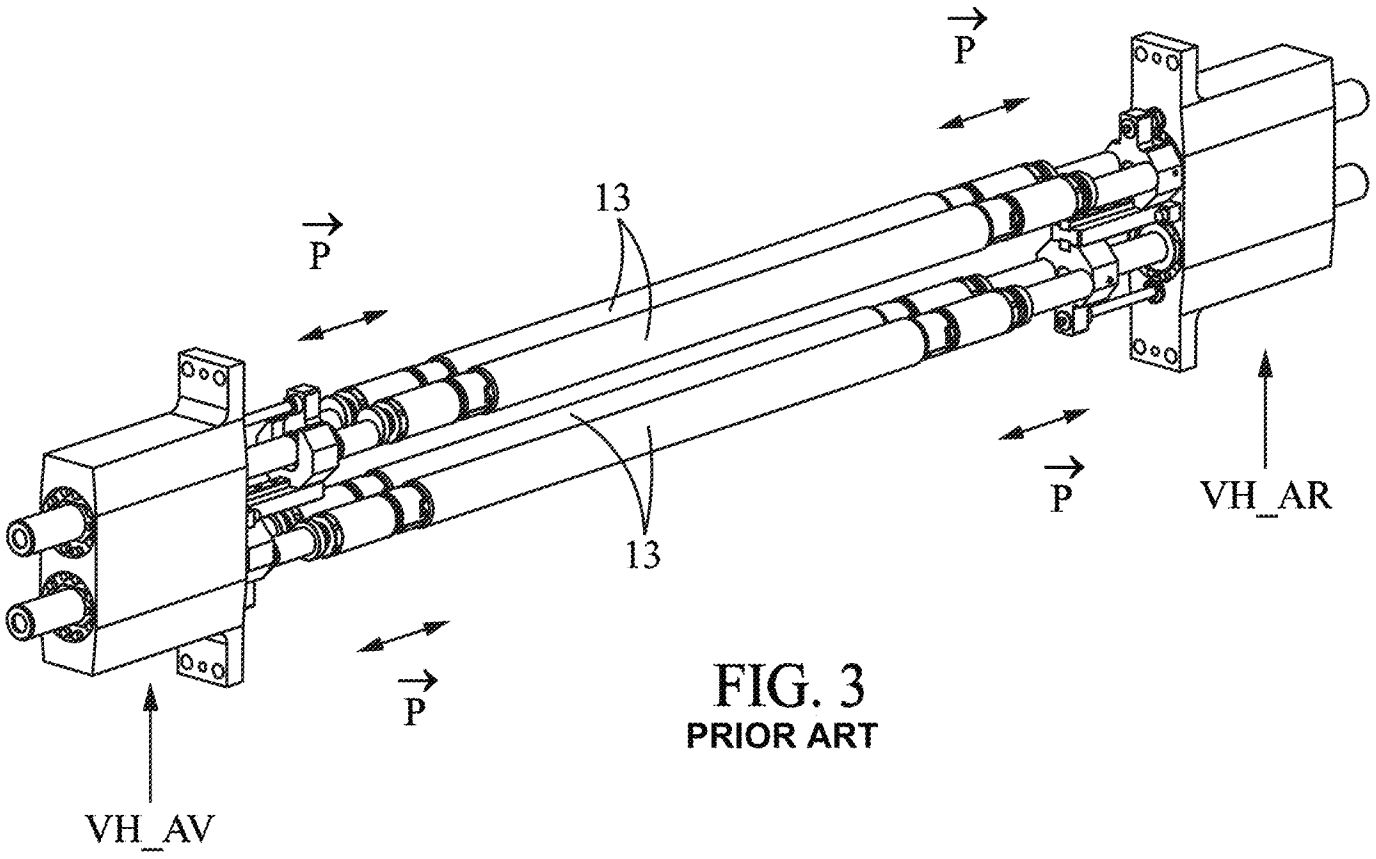
FIG. 3 PRIOR ART

For these reasons, rolling mills including a device for the lateral movement of the first cylinders of the push-push type are preferred, such a system, illustrated in FIG. 3, being described in the document EP 1 213 060.

The push-push system is composed of an arrangement of hydraulic actuators at the front VH_AV and at the rear VH_AR, each of these hydraulic actuators VH_AV and VH_AR being configured so as to adjust the position of the first intermediate cylinders 13 by exerting only a thrust force on the support faces of the cylinder stops 13.

This push-push system requires no attachment or coupling.

The push-push system is therefore more robust than the push-pull system.

The applicant does however observe that at the present time the push-push system cannot be integrated on a rolling mill having a small gate as described above, in particular because of the space requirement for the thrust actuators VH_AV situated at the front of the rolling mill.

In addition, integrating such actuators on a small gate as described above would interfere with the rotation of the small gate and would limit the retraction thereof to allow access of the operators to the rolling-mill stand, in particular during maintenance operations on the second intermediate cylinders 14, 15 and on the support rollers A, B, C, D, E, F, G, H.

In order to obtain sufficient retraction of the small gate, the arms thereof would have to be extended but, in this case, the pivots of the small gate would be situated at the edge of the main gate and would interfere with the complete opening of the main gate necessary for removal of the second intermediate cylinders and support rollers.

The applicant submits that the prior art offers no satisfactory solution making it possible to combine, on a rolling mill of the Sendzimir type, a push-push system with a small gate, while keeping the ability to open the small gate and the main gate.

SUMMARY AND SUBJECT MATTER OF THE PRESENT INVENTION

The present invention aims to improve the situation described above.

One of the objects of the present invention is to easily access the working cylinders (and optionally the intermediate cylinders) on a rolling mill of the Sendzimir type integrating a push-push system, without opening the main gate.

To this end, the subject matter of the present invention relates to a rolling mill, for example a rolling mill of the Sendzimir type, which advantageously comprises a rolling-mill stand containing a plurality of cylinders, preferably twenty cylinders.

Among the cylinders of the rolling mill according to the present invention, there are at least: two working cylinders and two pairs of cylinders referred to as intermediate cylinders; these intermediate cylinders are arranged together to support the two working cylinders in the direction of rolling.

Such a rolling mill may for example be a twenty-cylinder rolling mill of the Sendzimir type as described above and illustrated in FIG. 1.

Advantageously, the rolling mill according to the present invention comprises a main gate on the front face of the rolling mill, this main gate being able to open to allow access to all the cylinders. This main gate has an opening.

Advantageously, the rolling mill according to the present invention further comprises a device for lateral movement of the intermediate cylinders.

Lateral movement means here a lateral movement with respect to the direction of rolling.

Preferably, the lateral-movement device is of the push-push type: thus the lateral-movement device comprises a first pair of two hydraulic actuators positioned at the bottom of the rolling-mill stand and a second pair of two hydraulic actuators positioned on the front face of the rolling-mill stand.

According to the present invention each hydraulic actuator has a portion intended to be in abutment on one of the ends of the intermediate cylinders, and is configured so as to exert a thrust force in order to allow a lateral movement of the intermediate cylinders.

According to a first advantageous feature of the present invention the rolling mill comprises a removable small gate able to have at least one open position and one closed position.

Advantageously, in the closed position, the small gate closes off the opening in the main gate and serves as a lateral stop for the working cylinders and optionally the intermediate cylinders.

In the open position, the small gate allows access to the working cylinders and optionally to the intermediate cylinders.

According to a second advantageous feature of the present invention, the small gate is configured so as to integrate the second pair of two hydraulic actuators.

Thus, by virtue of this removable small gate that integrates the hydraulic actuators, opening and closing the small gate does not interfere with the opening and closing of the main gate. This is because, by virtue of this arrangement of the small gate, the kinematics relating to the opening and closing of the small gate takes place independently of the opening and closing of the main gate.

Moreover, by virtue of this arrangement, the opening of the small gate is complete: it is possible to remove and replace the working cylinders and optionally the first intermediate cylinders.

Advantageously, the small gate according to the present invention comprises motorisation means to allow motorised opening and/or closing of the small gate. Preferably, the rolling mill comprises control means configured so as to remotely control the motorisation means.

In an advantageous variant, the small gate according to the present invention further comprises at least one detector connected to the motorisation means and configured so as to control the opening and closing of the small gate. Thus, when for example the detector detects an obstacle on the opening or closing path of the small gate, then, in this case, the detector can prevent the opening or closing of the small gate.

Advantageously, the small gate comprises fixing means.

In a variant, these fixing means are fixed to the main gate and are configured so as to securely connect the small gate to the main gate, in particular in the closed position.

In an alternative variant, the fixing means are fixed to the rolling-mill stand and are configured so as to securely connect the small gate to the rolling-mill stand, in particular in the closed position. In this alternative, the main gate in the closed position is sandwiched between the small gate and the stand.

Advantageously, it is possible to provide an embodiment in which the main gate is removable and is able to be temporarily disconnected from the rolling-mill stand.

In a first advantageous embodiment, the fixing means are configured so that, in the open position, the small gate is disconnected from the main gate.

In this embodiment, the rolling mill further comprises a carriage that is able to be positioned close to the small gate and has rails on which, when the small gate is disconnected from the main gate, the small gate is able to translate as far as a stop in order to reach the open position and allow access to the working cylinders and optionally to the intermediate cylinders.

Preferably, this translation is instrumented by a motorisation and gearing system for conducting the small gate as far as the stop in a controlled fashion.

This clever embodiment facilitates the work of the operator since it limits manipulations of the small gate and completely leaves clear the working field facing the opening of the main gate and thus frees up access to the working cylinders and optionally to the intermediate cylinders when the small gate is in the open position.

Preferably, the carriage comprises a conveyor belt. Such a belt enables the cylinders to be borne and thus assists the removal and introduction of the working cylinders and optionally of the intermediate cylinders of the rolling-mill stand, when the small gate is in the open position.

Preferably, the carriage further comprises height-adjustment means to allow the adjustment for height of the conveyor belt with respect to the working cylinders and intermediate cylinders that it is wished to extract from the rolling-mill stand. Preferably, these adjustment means comprise at least one hydraulic actuator.

In an advantageous variant, the small gate is equipped with a clamp that has gripping means for holding at least one cylinder and is configured to drive said at least one cylinder in a translation movement when the small gate is opened as far as an open position in order to at least partially extract said at least one cylinder from the rolling-mill stand (10). This variant greatly reduces the maintenance times and operations.

Advantageously, the fixing means comprise fixing clamps.

Such fixing means secure the fixing of the small gate to the main gate (or to the rolling-mill stand) in the closed position, and thus prevents opening of the small gate under the transverse rolling forces. A person skilled in the art will understand here that other equivalent fixing means may also be envisaged in the context of the present invention to allow a closed position in which the small gate is securely fixed to the main gate (or to the rolling-mill stand), and an open position in which the small gate is disconnected from the main gate (or from the rolling-mill stand) and can thus be positioned against the carriage stop.

In a second advantageous embodiment, the fixing means comprise retraction means that are fixed to the main gate; these means are situated projecting from the main gate opposite to the retraction means of the main gate, the retraction means of the main gate being securely fixed to the rolling-mill stand.

Thus, in this embodiment, opening and closing the small gate does not interfere with the opening and closing of the main gate.

Preferably, the means for retraction of the small gate and/or of the main gate consist of a hinge system. Such hinge systems extend substantially in the height of the rolling mill.

Advantageously, the means of retraction of the small gate are positioned as close as possible to the edge of the main gate opposite to the edge on which the retraction means of the main gate are fixed.

By virtue of this configuration, the kinematics relating to the opening and closing of the small gate does not interfere with the kinematics relating to the opening and closing of the main gate.

In a variant, the retraction means of the small gate are fixed to the small gate by a pair of arms.

Preferably, the fixing means comprise a locking mechanism coupled to the retraction means, such a locking mechanism comprising a hook that can be actuated by a lever to allow locking of the small gate in the closed position. A person skilled in the art will understand here that other equivalent locking mechanisms can also be envisaged in the context of the present invention to allow a closed position in which the fixing of the small gate with respect to the main gate is locked.

Thus, the subject matter of the present invention described above makes it possible to solve the various drawbacks identified in the prior art presented in the preamble; the subject matter of the present invention makes it possible in particular to combine, on a rolling mill, a system of the push-push type, appreciated for its robustness, and a small gate, appreciated for protecting the maintenance operations and avoiding an excessively long cylinder replacement time, such a combination not being possible up until now with current configurations.

BRIEF DESCRIPTION OF THE ACCOMPANYING FIGURES

Other features and advantages of the present invention will emerge from the following description with reference to the accompanying FIGS. 4 to 8*a*-8*b*, which illustrate several variant embodiments thereof with no limitative character and in which:

The prior art is described in the accompany FIGS. 1, 2*a*, 2*b* and 3:

FIG. 1 depicts a schematic view of a cross section of a twenty-cylinder rolling mill illustrated in U.S. Pat. No. 5,193,377 and U.S. Pat. No. 5,471,859;

FIG. 2*a* depicts equipping the main gate PP of a rolling mill LA with a simple small gate PT situated at the center thereof, thereby allowing rapid and safe changing of working cylinders 12 and the first intermediate cylinders 13, without requiring the main gate PP to be opened;

FIG. 2*b* depicts a push-pull system that comprises an arrangement of hydraulic actuators VH configured so as to alternately "push" and "pull" the first intermediate cylinders 13; and FIG. 3 illustrates rolling mill with a device for the lateral movement of the first cylinders of the push-push type, which is described in EP 1 213 060.

Figure 4:
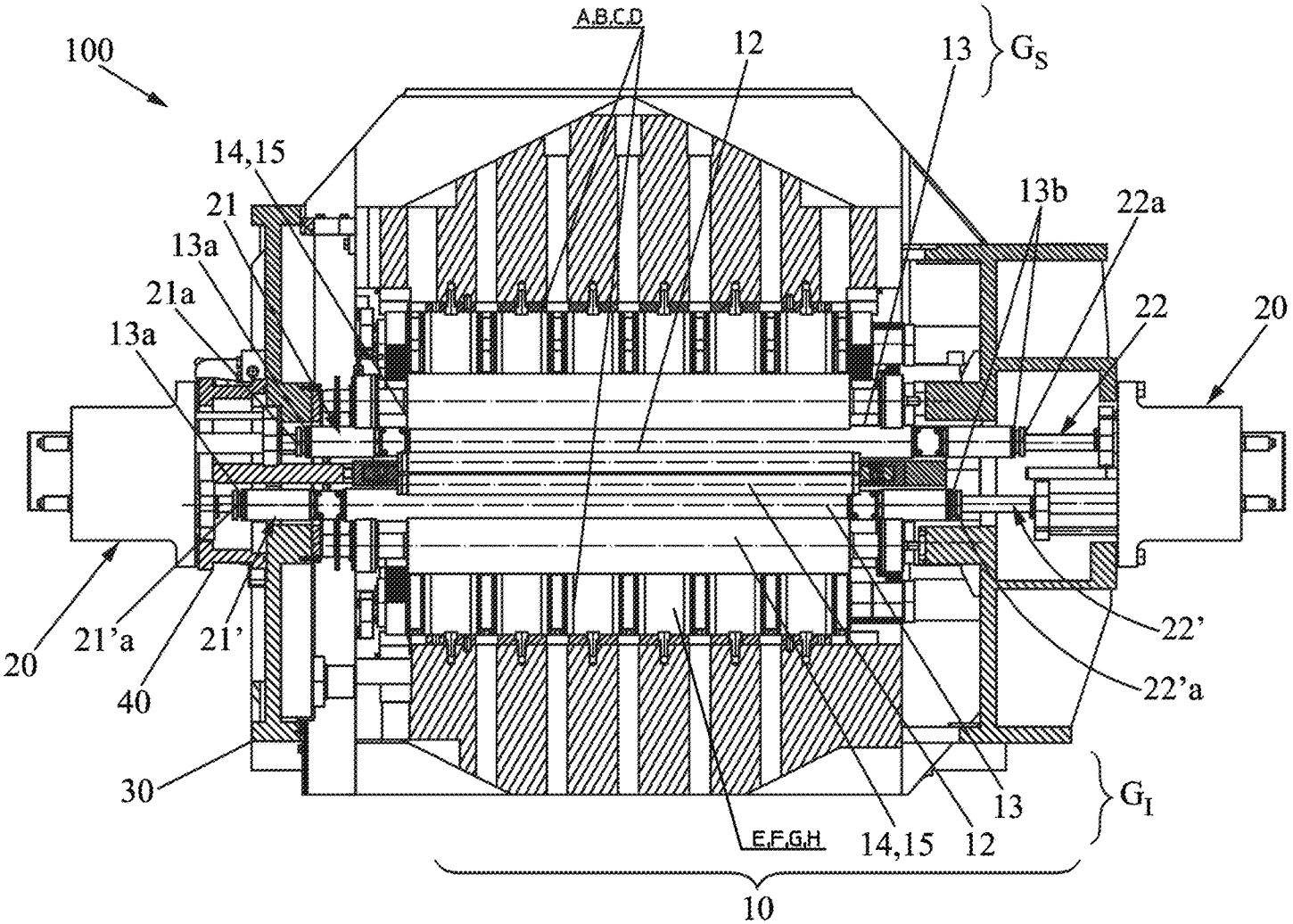
Figure 5A:
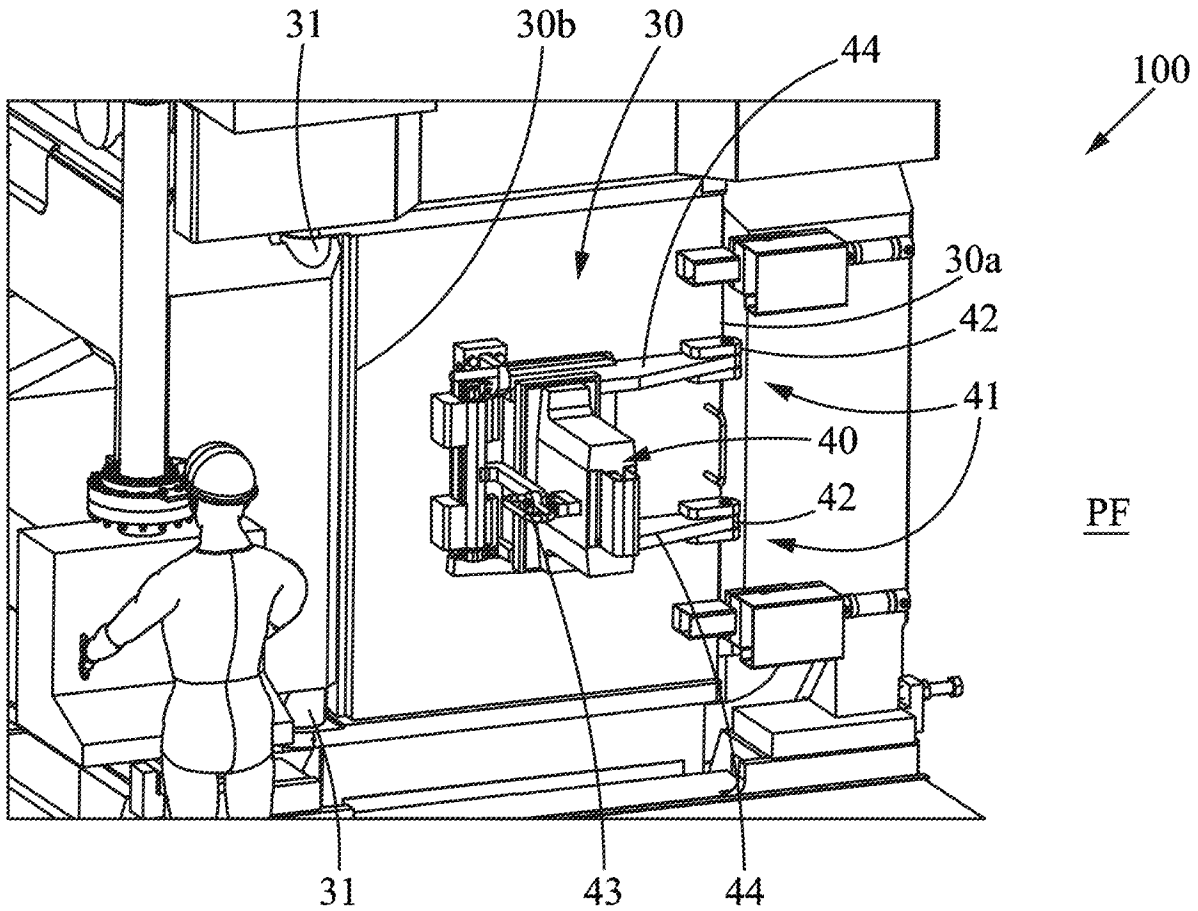
Figure 5B:
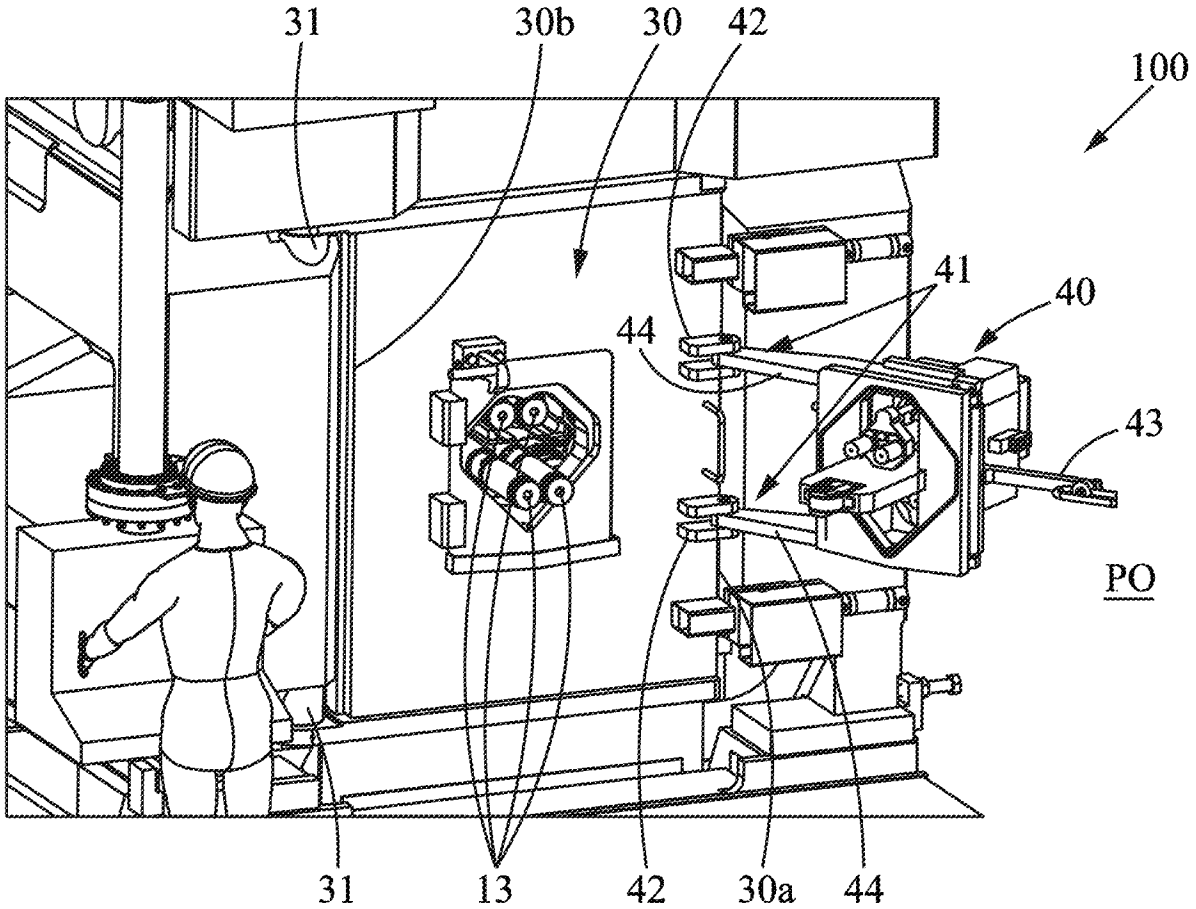
Figure 5C:
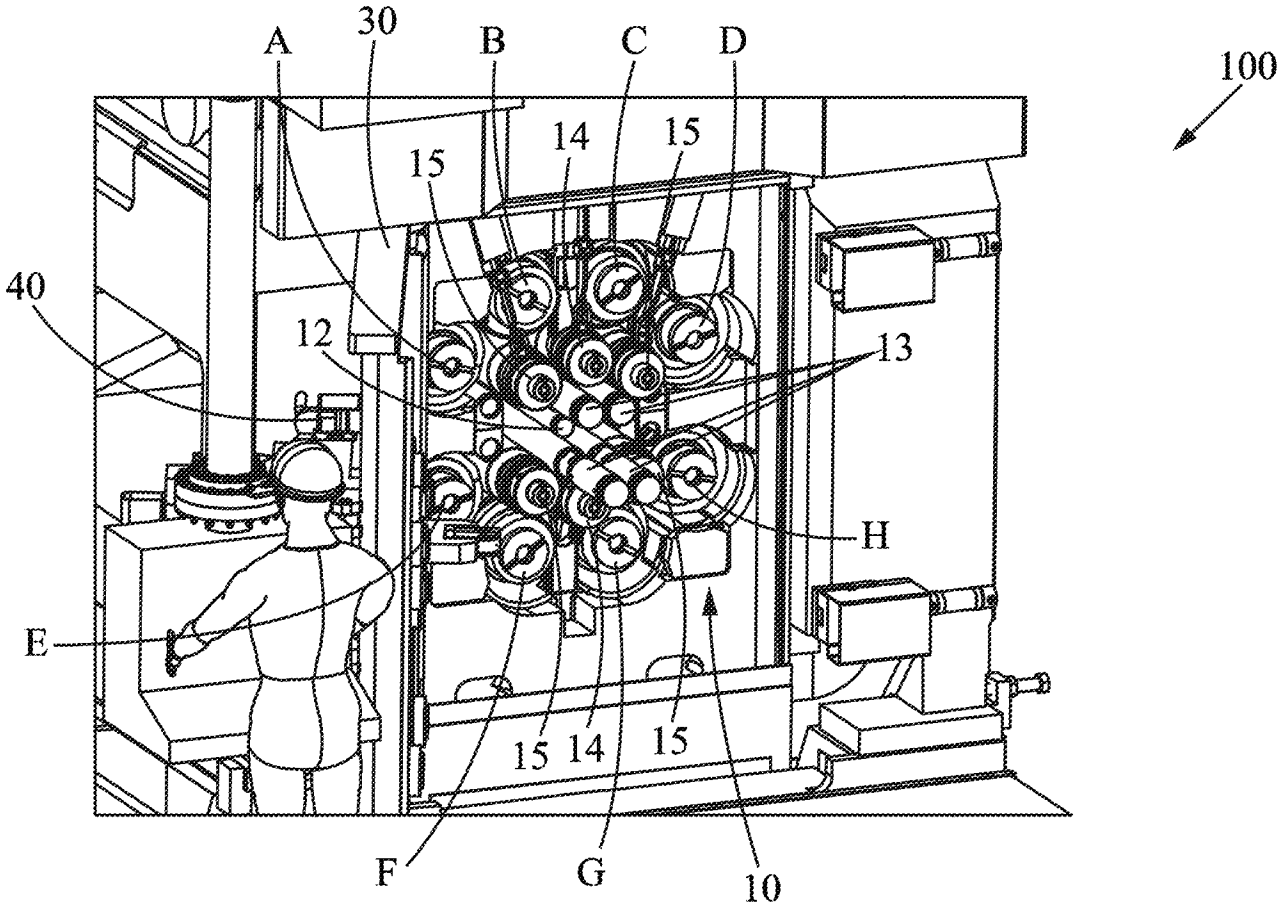
Figure 6A:
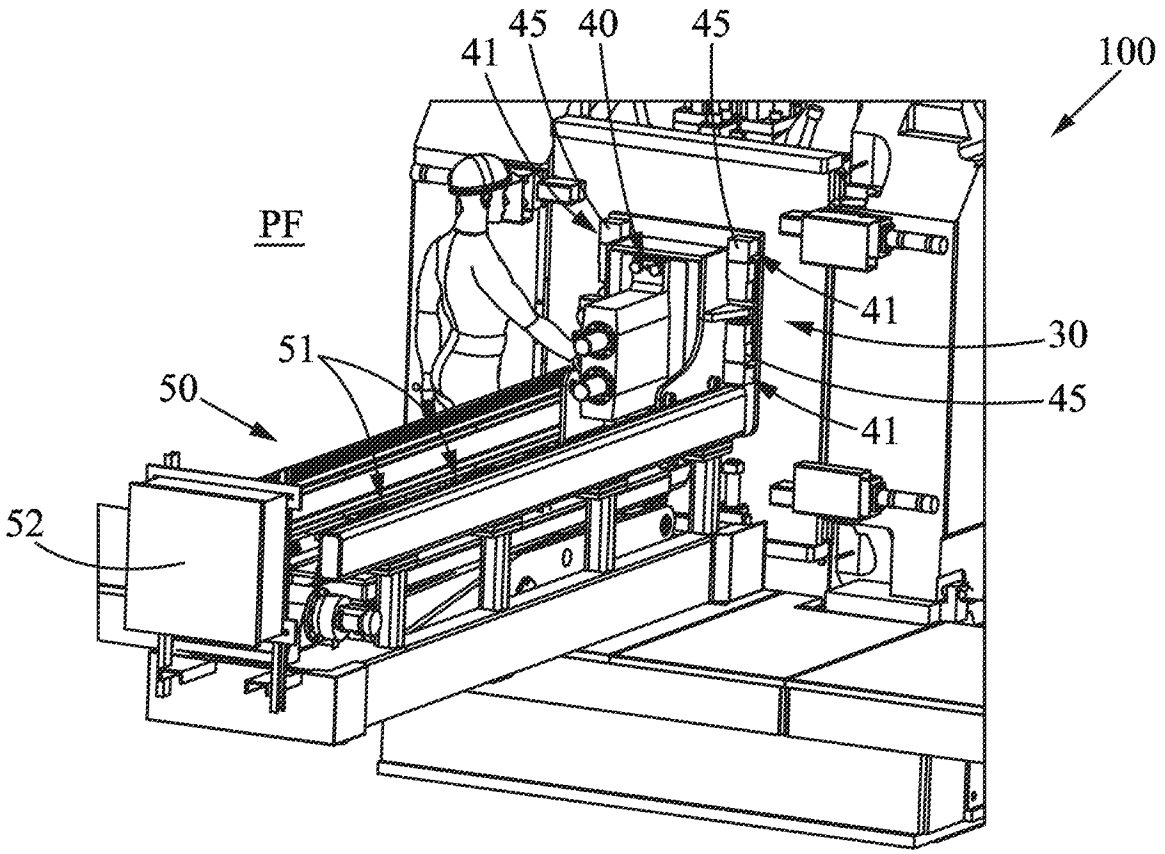
Figure 6B:
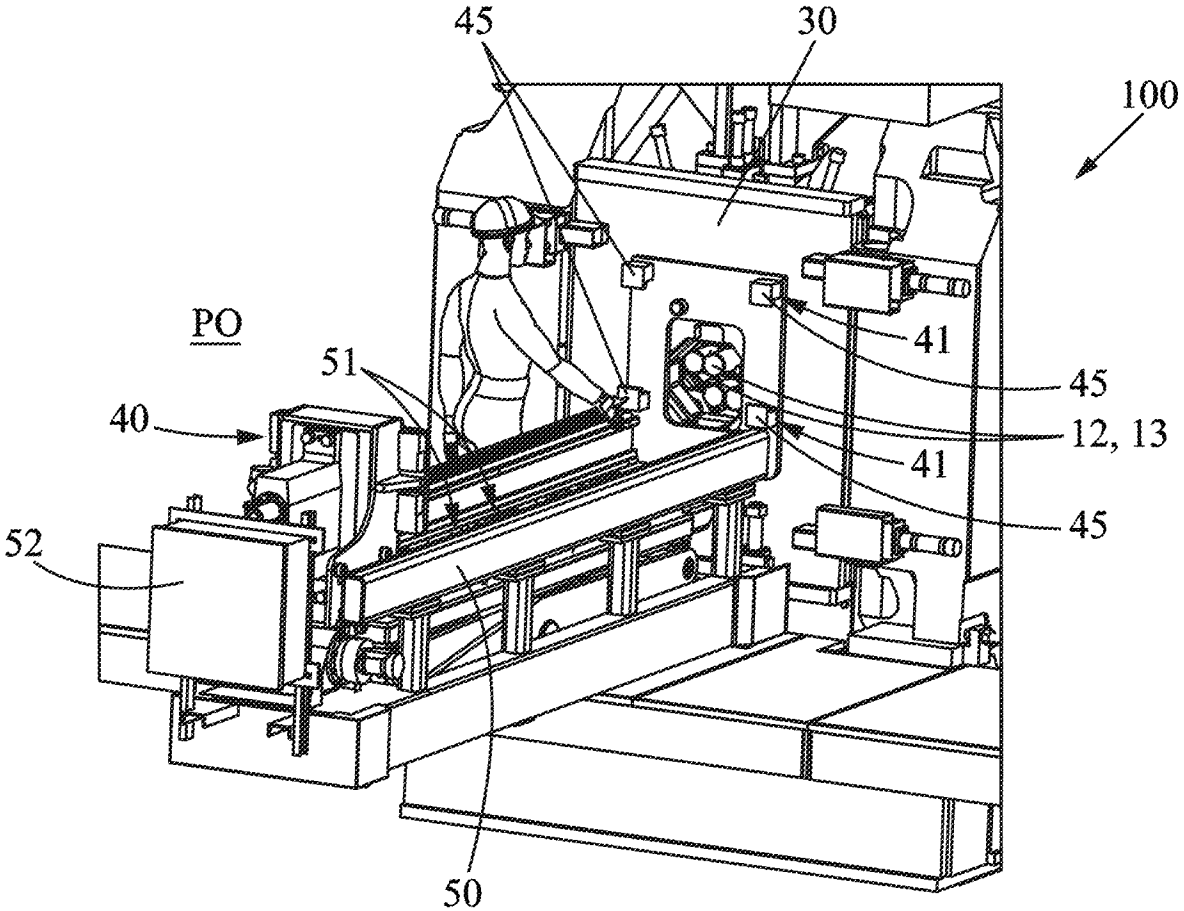
Figure 6C:
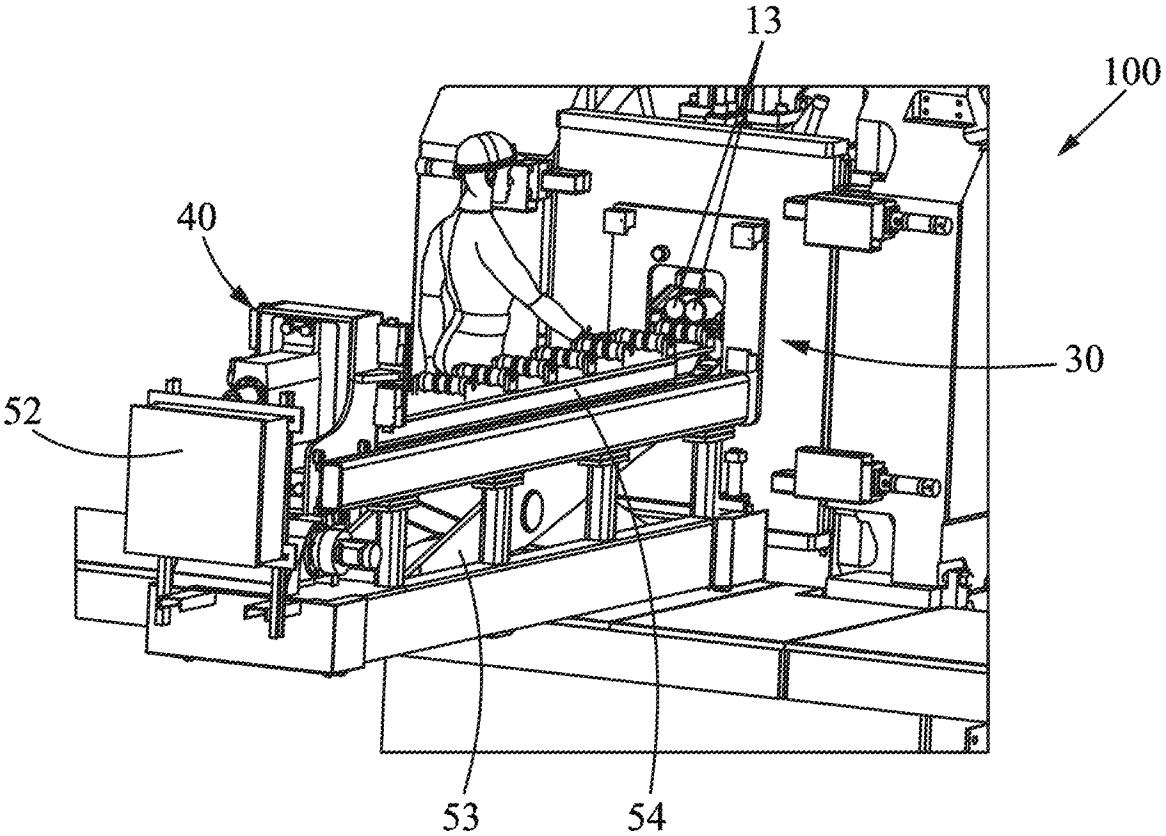
Figure 7:
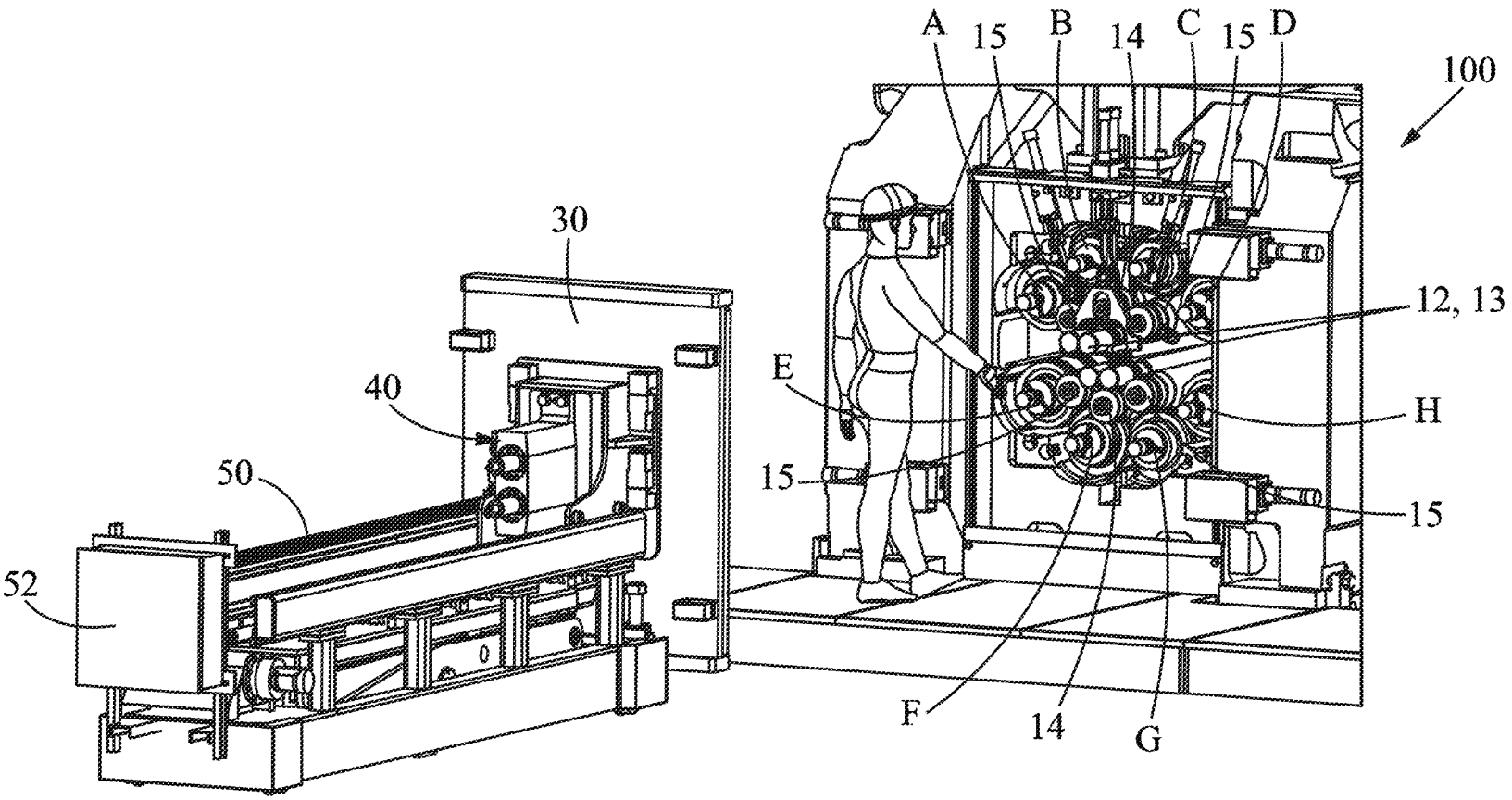
Figure 8A:
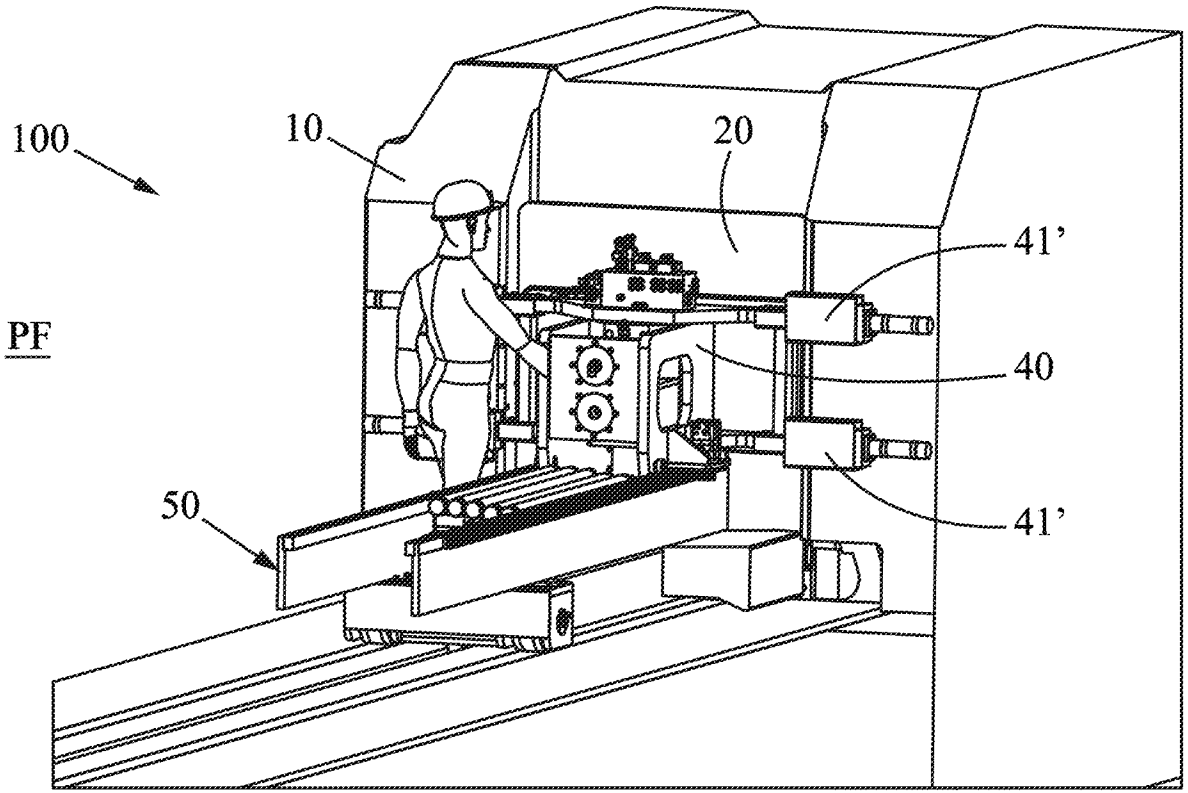
Figure 8B:
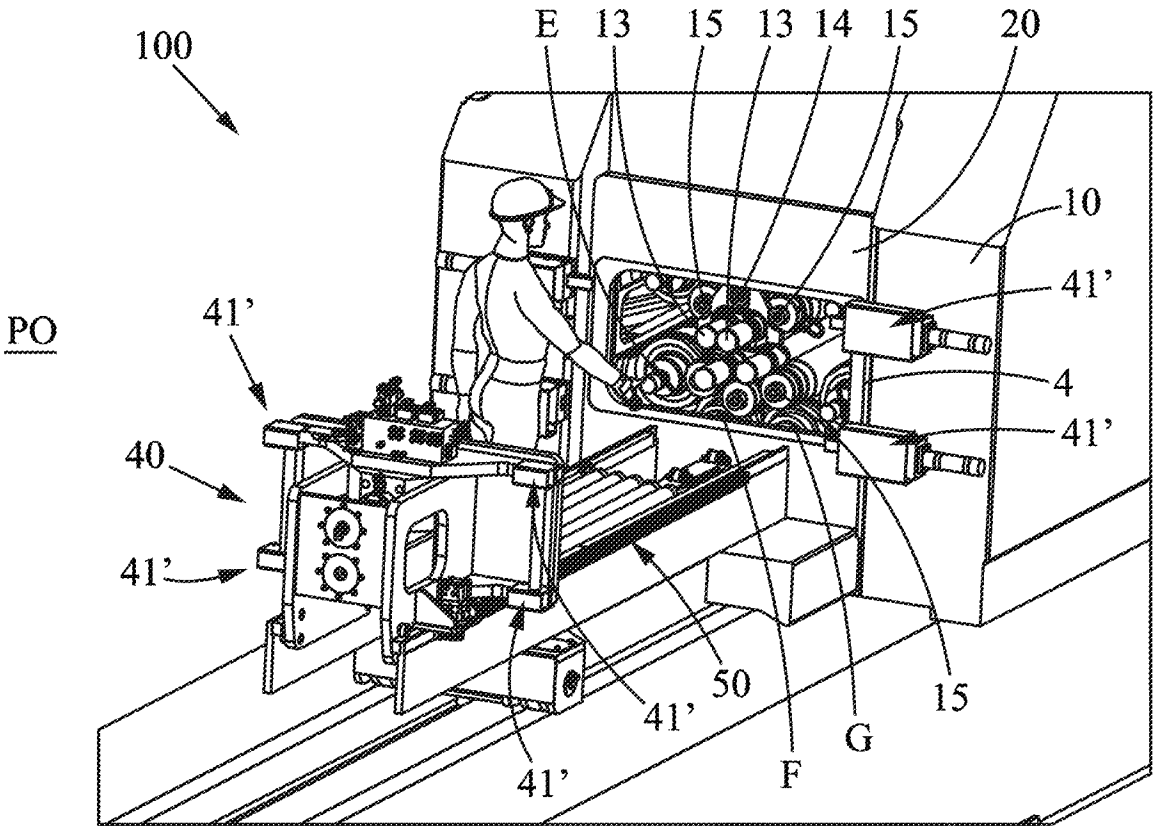

FIG. 4 depicts a schematic view in cross section of a rolling mill according to a first advantageous embodiment of the present invention;

FIGS. 5*a*-5*b*-5*c* each depict a schematic perspective view of the front face of a rolling mill according to FIG. 4;

FIGS. 6*a*-6*b*-6*c* each depict a schematic perspective view of the front face of a rolling mill in accordance with a second advantageous embodiment of the present invention;

FIG. 7 for its part depicts a schematic perspective view relating to a variant in which the main gate is removable; and FIGS. 8*a*-8*b* each depict a schematic perspective view of the front face of a rolling mill according to a third advantageous embodiment of the present invention.

DETAILED DESCRIPTION OF SEVERAL EXAMPLE EMBODIMENTS

A rolling mill according to several example embodiments will now be described hereinafter referring conjointly to FIGS. 4 to 8*a*-8*b*.

The various examples described here all relate to a rolling mill of the Sendzimir type with twenty cylinders like the one described previously and illustrated in FIG. 1. Naturally a person skilled in the art will understand here that the present invention may also be adapted to other types of multi-cylinder rolling mills.

Thus, in the examples described here, the rolling mill 100 according to the present invention comprises a rolling-mill stand 10 in which there are distributed a lower group $G_I$ and an upper group $G_S$ each composed of a working cylinder 12, two first intermediate cylinders 13, three second intermediate cylinders 14 and 15, and four support cylinders, or support rollers, which are outside the arrangement and are denoted A, B, C and D for the upper group $G_S$ and E, F, G, H for the lower group $G_I$.

In the various examples described here, the rolling mill 100 according to the present invention is equipped with a push-push system, such as the one illustrated in FIG. 3, to move the first intermediate cylinders 13.

As stated above, the rolling mill 100 is a twenty-cylinder rolling mill: it therefore comprises two pairs of first intermediate cylinders 13.

Thus, in the various examples described here, the rolling mill 100 comprises a push-push system that has a device 20 for lateral movement of the intermediate cylinders 13 composed of an arrangement of two pairs of hydraulic actuators 21 and 21' at the front and two pairs of hydraulic actuators 22 and 22' at the rear.

More precisely, the lateral movement device 20 comprises two front double hydraulic actuators 21-21' and two rear double hydraulic actuators 22-22' that are configured together so as to adjust the position of the first intermediate cylinders 13 using solely a thrust force P on the support forces of the cylinder stops 13.

In the various examples described here, each hydraulic actuator 21-21' and 22-22' has respectively a portion 21*a*-21*a*' and 22*a*-22*a*' that is in abutment on one of the ends 13*a*-13*b* of the intermediate cylinders 13, and is configured so as to exert a thrust force P alternately on these ends 13*a*-13*b* to allow a lateral movement of the intermediate cylinders 13.

In such a push-push system, it will easily be understood that, when the hydraulic actuator 21 exerts a thrust force P on an intermediate cylinder 13, then the opposite hydraulic actuator 22 is inactive, and vice versa.

In the various examples described here, the rolling mill 100 according to the present invention comprises a motorised main gate 30 that is on the front face of the rolling mill 100 and allows access to all the cylinders 12, 13, 14, 15 and A, B, C, D, E, F, G and H when this main gate 30 is open.

As explained in detail in the preamble of the present description, it is desirable to be able to access only the cylinders 12 and 13, in particular for maintenance reasons. Such dedicated access makes it possible to avoid the opening time for the main gate 30, which is very often too long, such access moreover being safer for the operator.

In the prior art, this dedicated access is made possible by the presence of a small gate that in the closed position covers the opening present on the main gate and allowing access to the cylinders 12 and 13. However, as explained previously, the combination on a rolling mill of a push-push system and a small gate such as those designed up until now in the prior art was not possible.

One of the objectives of the present invention is therefore to design a rolling mill of the Sendzimir type integrating a push-push system and where access to the working cylinders 12 and to the first intermediate cylinders 13 is made possible by an opening system such as a small gate. It is furthermore necessary for the opening and closing of this gate not to interfere with the opening and closing of the main gate, as is the case in the prior art.

It is moreover necessary for the small gate to open completely to allow removal of the cylinders.

The first example embodiment described in FIG. 4 achieves the objective sought.

To do this, the rolling mill 100 according to this first example embodiment has a small gate 40 which, according to a first advantageous feature, is removable: it therefore has a closed position PF (illustrated in FIG. 5*a*) and an open position PO (illustrated in FIG. 5*b*); this open position PO allows access to the working cylinders 12 and to the intermediate cylinders 13.

In the closed position PF, the small gate 40 closes the opening in the main gate 30.

Moreover, according to a second advantageous feature of the present invention illustrated in FIG. 4, the small gate 40 integrates the front hydraulic actuator 21-21'.

The fact that the small gate 40 is removable and integrates the front hydraulic actuators 21-21' allows opening and closing of the small gate 40 without interfering with the opening and closing of the main gate 30. In addition, with such a configuration, as illustrated in FIG. 5*b*, the opening of the small gate is complete and allows removal of the cylinders.

Preferentially, the small gate 40 comprises a plate (preferably consisting of a strong rigid material) having an opening in its middle part. The front hydraulic actuators 21-21' are fixed to the small gate on either side of this opening. More particularly, as illustrated in FIG. 4, in the closed position PF, the motive part of the hydraulic actuators 21-21' is situated outside the stand of the rolling mill 10 and the functional part of the hydraulic actuators 21-21' is situated inside the stand of the rolling mill 10. This reduces the space requirement of the actuators 21-21' and avoids the opening of the small gate being partial and/or being blocked by the stand of the rolling mill.

In the example embodiment described in FIGS. 5*a* to 5*c*, the small gate 40 is retractable, and opens and closes conventionally like a door. Thus, in this example, in order not to interfere the opening and closing of the main gate 30, the fixing means 41 comprise retraction means 42 such as hinges that are fixed directly or indirectly to the main gate 30; these retraction means 42 projecting from the main gate are positioned opposite to the retraction means 31 of the main gate 30.

More particularly, in this example, the retraction means 42 are positioned as close as possible to the edge 30*a* of the main gate 30 that is opposite to the edge 30*b* to which the retraction means 31 of the main gate 30 are fixed.

In the example described here, the small gate 40 is position substantially at the centre of the main gate 30.

As illustrated in FIG. 5*a*, in this example, the small gate 40 comprises a pair of arms 44 extending radially as far as the edge 30*a* of the main gate 30. These arms 44 thus form a pivot articulation with the retraction means 42 to enable the main gate 30 to be opened and closed.

Thus, by virtue of this configuration, the kinematics relating to the opening and closing of the small gate 41 is a mirror of the kinematics relating to the opening and closing of the main gate.

In this example, the retraction means 42 of the small gate are composed of two hinges.

In this example, the fixing means 41 further comprise a locking mechanism 43 coupled to the retraction means 42 and comprising a hook that can be actuated by a lever to enable the small gate 40 to be locked in the closed position.

In this example, an operator wishing to open the small gate 40 merely needs to unlock the mechanism 43 by actuating the lever. Because of the configuration described above, the small gate 40 is opened simply: the hydraulic actuators 21-21' integrated in the small gate 40 in fact enable the small gate to be opened sufficiently to afford complete access to the cylinders 12 and/or 13.

FIGS. 6*a* to 6*c* depict an alternative to the example embodiment in FIGS. 5*a* to 5*c*.

In this second advantageous example embodiment, the rolling mill 100 has features common with the embodiment in FIGS. 5*a* to 5*c*.

Thus the rolling mill according to these FIGS. 6*a* to 6*c* is a twenty-cylinder rolling mill of the Sendzimir type, which comprises in the same way:

a rolling-mill stand 10 containing twenty cylinders;

a main gate 30 affording access to all these cylinders, and a removable small gate 40 which, in the closed position, is securely fixed to the main gate 30 by fixing means 41.

In this alternative example, as illustrated in FIG. 6*b*, the fixing means 41 consist of a set of four fixing clamps 45 positioned at the four corners of the small gate and configured so that the small gate 40 is able to be temporarily disconnected from the main gate 30.

Thus, in this example and as illustrated in FIG. 6*a*, during the rolling and before opening the small gate 40, the operator positions a carriage 50 close to the small gate 40. When the small gate is opened, he disengages the clamps 45 in order to disconnect the small gate 40 from the main gate 30.

As illustrated in FIG. 6*b*, the carriage 50 has a pair of rails 51 on which, when the small gate 40 is disconnected from the main gate 30, the small gate 40 can translate as far as a stop 52 in order to reach the open position PO.

In this position PO, the operator can easily access the working cylinders 12 and the intermediate cylinders 13.

As illustrated in FIG. 6*c*, once in the open position PO, the operator can actuate the height-adjustment means 53 in order to adjust the height of the conveyor belt 54 so as to allow removal of the working cylinders 12 and/or the intermediate cylinders 13 required. Thus, by virtue of this configuration, the operator can easily perform his maintenance operation on the cylinders by removing these cylinders from the rolling-mill stand.

As indicated previously in the present description, the extraction of these cylinders can be facilitated by a clamp especially adapted for this purpose and making it possible to extract one or more cylinders by opening the small gate.

Once the cylinders have been brought out, he can reintroduce the (new) cylinders 12 and/or 13 in the stand 10 (or replace them) and close the small gate 40 again by means of the reverse operations.

He can then move the carriage 50 away in order to leave clear the space around the rolling mill 100 to enable the main gate 30 to be opened. Preferably, the carriage slides on rails embedded in the floor (not shown here).

FIG. 7 depicts a variant embodiment in which, alternatively, the main gate 30 is able to be temporarily disconnected from the stand of the rolling mill 100. This variant can be adapted in particular to the second example embodiment described above.

In this variant, the main gate is fixed to the stand of the rolling mill 100 by fixing means allowing secure temporary fixing of the main gate to the stand of the rolling mill. This variant is advantageous for allowing good access to all the cylinders when the main gate is in the open position as illustrated in FIG. 7.

In another advantageous embodiment illustrated in FIGS. 8*a* and 8*b*, provision is made for the small gate 40 to have a width substantially less than the width of the main gate 30. Here, as can be seen in FIG. 8*b*, the opening formed in the main gate 30 that affords access to the cylinders 12 and 13 is wide; the gate 30 in the closed position PF coves this opening.

In this embodiment, the small gate 40 has fixing means 41' that are mounted directly on the rolling-mill stand 10.

Thus, in this embodiment, the small gate 40 in the closed position PF is firmly fixed no longer to the main gate 30, but to the rolling-mill stand 10, which avoids in particular the main gate 30 being subject to the forces exerted by the weight of the small gate 40.

This embodiment can be combined with the previous embodiment. Thus it is possible to provide for the main gate 30 to be supported by the cylinder-change carriage.

In this example, the main gate 30 is sandwiched between the small gate 40 and the stand 10 when the small gate 40 is closed. This embodiment is particularly advantageous since it avoids the use of hydraulic means for closing the main gate.

A person skilled in the art will understand here that this alternative comprises all the elements described for the other embodiments with the exception of the fixing means 41', which differ here because these means 41' are arranged so as to securely fix the small gate 40 in the closed position to the rolling-mill stand 10.

Thus the rolling mill described according to the various example embodiments above makes it possible through its various technical, structural and functional features to remedy the drawbacks identified in the prior art.

It should be noted that this detailed description relates to particular example embodiments of the present invention but that under no circumstances does this description have any limitative character with respect to the subject matter of the invention. Quite the contrary, its objective is removing any lack of precision or faulty interpretation of the following claims.

The invention claimed is:

1. A rolling mill (100) comprising:

a rolling-mill stand (10) containing a plurality of cylinders, including two working cylinders (12) and two pairs of intermediate cylinders (13), arranged together in order to support said two working cylinders (12) in the direction of rolling, a main gate (30) on the front face of the rolling mill (100) for accessing all the cylinders and having an opening, the main gate (30) able to have either an open position for accessing all the cylinders or a closed position, and a device (20) for lateral movement of the intermediate cylinders (13), of a push-push system, comprising a first pair of two hydraulic actuators (22, 22') positioned at the bottom of the rolling-mill stand (10) and a second pair of two hydraulic actuators (21, 21') positioned on the front face of the rolling-mill stand (10), each of the hydraulic actuators (21, 21', 22, 22') having a portion (21*a*, 21*a'*, 22*a*, 22*a'*) in abutment on one of the ends (13*a*, 13*b*) of the intermediate cylinders (13) and being configured so as to exert a thrust force (P) to allow a lateral movement of the intermediate cylinders (13), wherein:

the rolling mill comprises a removable small gate (40) able to have at least:

a) a closed position (PF) in which the small gate (40) closes the opening formed in the main gate (30) and serves as a lateral stop for the working cylinders (12) and optionally the intermediate cylinders (13), and b) an open position (PO) affording access to the two working cylinders (12) and optionally to the intermediate cylinders (13), said small gate (40) integrates the second pair of hydraulic actuators (21, 21'), the small gate (40) comprises fixing clamps (45) configured so as to securely connect the small gate (40) to the main gate (30) in the closed position (PF), and wherein the fixing clamps (45) are configured so that the small gate (40) is able to be disconnected from the main gate (30), and the rolling mill (100) comprises a carriage (50) positioned close to the small gate (40) and having rails (51) on which, when the small gate (40) is disconnected from the main gate (30), said small gate (40) is able to translate as far as a stop (52) in order to reach the open position (PO) and allow the removal of the working cylinders (12) and the intermediate cylinders.

2. The rolling mill (100) according to claim 1, wherein the main gate (30), when the small gate (40) is in the closed position (PF), is sandwiched between the small gate (40) and the stand (10).

3. The rolling mill (100) according to claim 1, wherein the small gate (40) is equipped with a clamp having gripping means for holding at least one cylinder (12, 13) and being configured so as to drive said at least one cylinder in a translation movement when the small gate is opened as far as the open position in order to at least partially extract said at least one cylinder (12, 13) from the rolling-mill stand (10).

4. The rolling mill (100) according to claim 1, wherein the main gate (30) is removable and is able to be temporarily disconnected from the rolling-mill stand (10).

5. The rolling mill (100) according to claim 1, wherein the carriage (50) comprises a conveyor belt (53) for assisting the removal of the working cylinders (12) and optionally the intermediate cylinders (13) from the rolling-mill stand (10), when the small gate (40) is in the open position (PO).

6. The rolling mill (100) according to claim 5, wherein the carriage (50) comprises height-adjustment means (54) to allow the adjustment of the conveyor belt (53) for height with respect to the working cylinders (12) and intermediate cylinders (13) that are to be extracted from the rolling-mill stand (10).

7. A rolling mill (100) comprising:

a rolling-mill stand (10) containing a plurality of cylinders, including two working cylinders (12) and two pairs of intermediate cylinders (13), arranged together in order to support said two working cylinders (12) in the direction of rolling;

a main gate (30) on the front face of the rolling mill (100) for accessing all the cylinders and having an opening, the main gate (30) able to have either an open position for accessing all the cylinders or a closed position;

a device (20) for lateral movement of the intermediate cylinders (13), of a push-push system, comprising a first pair of two hydraulic actuators (22, 22') positioned at the bottom of the rolling-mill stand (10) and a second pair of two hydraulic actuators (21, 21') positioned on the front face of the rolling-mill stand (10), each of the hydraulic actuators (21, 21', 22, 22') having a portion (21*a*, 21*a'*, 22*a*, 22*a'*) in abutment on one of the ends (13*a*, 13*b*) of the intermediate cylinders (13) and being configured so as to exert a thrust force (P) to allow a lateral movement of the intermediate cylinders (13);

a removable small gate (40) configured to have at least:

a) a closed position (PF) in which the small gate (40) closes the opening formed in the main gate (30) such that the main gate (30) is in the closed position (PF) and serves as a lateral stop for the working cylinders (12) and optionally the intermediate cylinders (13), and b) an open position (PO) affording access to the two working cylinders (12) and optionally to the intermediate cylinders (13), wherein:

the small gate (40) integrates the second pair of hydraulic actuators (21, 21'), the small gate (40) comprises fixing clamps (45) fixed to the rolling-mill stand (10) and configured so as to securely connect the small gate (40) to the rolling-mill stand (10) in the closed position (PF), and the fixing clamps (45) are configured so that the small gate (40) is able to be disconnected from the main gate (30); and a carriage (50) positioned close to the small gate (40) and having rails (51) on which, when the small gate (40) is disconnected from the main gate (30), said small gate (40) is able to translate as far as a stop (52) in order to reach the open position (PO) and allow the removal of the working cylinders (12) and the intermediate cylinders.

8. The rolling mill (100) according to claim 7, wherein the main gate (30), when the small gate (40) is in the closed position (PF), is sandwiched between the small gate (40) and the stand (10).

9. The rolling mill (100) according to claim 7, wherein the carriage (50) comprises a conveyor belt (53) for assisting the removal of the working cylinders (12) and optionally the intermediate cylinders (13) from the rolling-mill stand (10), when the small gate (40) is in the open position (PO).

10. The rolling mill (100) according to claim 9, wherein the carriage (50) comprises height-adjustment means (54) to allow the adjustment of the conveyor belt (53) for height with respect to the working cylinders (12) and intermediate cylinders (13) that are to be extracted from the rolling-mill stand (10).

11. The rolling mill (100) according to claim 7, wherein the small gate (40) is equipped with a clamp having gripping means for holding at least one cylinder (12, 13) and being configured so as to drive said at least one cylinder in a translation movement when the small gate is opened as far as the open position in order to at least partially extract said at least one cylinder (12, 13) from the rolling-mill stand (10).

12. The rolling mill (100) according to claim 7, wherein the main gate (30) is removable and is able to be temporarily disconnected from the rolling-mill stand (10).

13. A rolling mill (100) comprising:

a rolling-mill stand (10) containing a plurality of cylinders, including two working cylinders (12) and two pairs of intermediate cylinders (13), arranged together in order to support said two working cylinders (12) in the direction of rolling;

a main gate (30) on the front face of the rolling mill (100) for accessing all the cylinders and having an opening, the main gate (30) able to have either an open position for accessing all the cylinders or a closed position;

a device (20) for lateral movement of the intermediate cylinders (13), of a push-push system, comprising a first pair of two hydraulic actuators (22, 22') positioned at the bottom of the rolling-mill stand (10) and a second pair of two hydraulic actuators (21, 21') positioned on the front face of the rolling-mill stand (10), each of the hydraulic actuators (21, 21', 22, 22') having a portion (21*a*, 21*a'*, 22*a*, 22*a'*) in abutment on one of the ends (13*a*, 13*b*) of the intermediate cylinders (13) and being configured so as to exert a thrust force (P) to allow a lateral movement of the intermediate cylinders (13); and a removable small gate (40) able to have at least:

a) a closed position (PF) in which the small gate (40) closes the opening formed in the main gate (30) such that the main gate (30) is in the closed position (PF)

and serves as a lateral stop for the working cylinders (12) and optionally the intermediate cylinders (13), and b) an open position (PO) affording access to the two working cylinders (12) and optionally to the intermediate cylinders (13), wherein:

the small gate (40) integrates the second pair of hydraulic actuators (21, 21'), the small gate (40) comprises fixing means (41) configured so as to securely connect the small gate (40) to the main gate (30) in the closed position (PF), said fixing means (41) comprises: hinges (42) fixed to the main gate (30), and a locking mechanism (43) comprising a hook, and wherein the hinges (42) project from said main gate (30) and opposite to the hinge system (31) of this said main gate (30).

14. The rolling mill (100) according to claim 13, wherein the retraction means (42) of the small gate (40) are positioned as close as possible to the edge (30*a*) of the main gate (30) opposite to the edge (30*b*) to which the retraction means (31) of the main gate (30) are fixed.

15. The rolling mill (100) according to claim 13, wherein the main gate (30), when the small gate (40) is in the closed position (PF), is sandwiched between the small gate (40) and the stand (10).

* * * * *